US006206707B1

(12) United States Patent
Huang

(10) Patent No.: US 6,206,707 B1
(45) Date of Patent: Mar. 27, 2001

(54) BOARD TO BOARD CONNECTOR

(75) Inventor: Guan-Fu Huang, Tu-Chen (TW)

(73) Assignee: Hon Hai Precision Inc. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/450,476

(22) Filed: Nov. 29, 1999

(30) Foreign Application Priority Data

Aug. 31, 1999 (TW) ..... 88214850

(51) Int. Cl.[7] ..... H01R 12/00
(52) U.S. Cl. ..... 439/74; 439/108
(58) Field of Search ..... 439/74, 83, 637, 439/630, 95, 108

(56) References Cited

U.S. PATENT DOCUMENTS 5,030,140 * 7/1991 Sugiyama ..... 439/607
5,057,028 * 10/1991 Lemke et al. ..... 439/108
5,626,500 * 5/1997 Yoshimura ..... 439/637
5,800,213 * 9/1998 Regnier et al. ..... 439/637
5,921,787 * 7/1999 Pope et al. ..... 439/74
5,921,814 * 7/1999 Maruyama ..... 439/607

* cited by examiner

*Primary Examiner*—Brian Sircus
*Assistant Examiner*—T. C. Patel
(74) *Attorney, Agent, or Firm*—Wei Te Chung

(57) ABSTRACT

An electrical connector comprises an insulative housing, a plurality of terminals and a plurality of shield plates. A pair of receiving channels and a plurality of recesses located between the receiving channels is defined through the insulative housing for receiving the terminals and the shield plates, respectively. A plurality of upper ribs and lower ribs is disposed on the inner walls of each receiving channel. Each terminal includes a contact portion, a retention portion, a transverse portion and a soldering tail. Each retention portion has a first retaining section and a second retaining section and the transverse portion establishes a transverse displacement therebetween. A pair of first locking barbs and a pair of second locking barbs are respectively formed on the first retaining section and the second retaining section of each terminal for latching the terminal to the insulative housing.

10 Claims, 9 Drawing Sheets

BOARD TO BOARD CONNECTOR

BACKGROUND OF THE INVENTION

The present invention relates to an electrical connector for engaging a daughter printed circuit board to a motherboard, and more particularly to an electrical connector which has long, resilient terminals reliably secured in an insulative housing facilitating mating with another electrical connector.

An electrical connector is often required to connect two printed circuit boards together for signal transmission therebetween. For some applications, an electrical connector having a high profile is desired. Therefore, terminals assembled in the connector are required to have a long dimension. One such electrical connector is disclosed in U.S. Pat. No. 5,626,500 (referring to FIG. 10) and has a pair of receiving channels 20 and a plurality of terminals 12. Each terminal 12 consists of a soldering tail 16, an elongate retention portion 18 and an S-shaped contact 14. The complicated contacts 14 and the elongate retention portion 18 result in the terminals 12 being unreliably secured in the housing. Furthermore, the terminals of a complementary connector (not shown), if improperly inserted, push into the cupped portions 143 of the ends 142 of the terminals 12 instead of the receiving channels 20, resulting in an unreliable contact and in a shortened lifespan for the terminal. Additionally, the terminals 12 and the housing with the receiving channels 20 can not be easily manufactured, and the housing is easily damaged. Thus, mass production is problematic.

BRIEF SUMMARY OF THE INVENTION

A main object of the present invention is to provide an electrical connector having a resilient terminal of a long dimension, which can be precisely positioned and reliably secured.

Another object of the present invention is to provide an electrical connector which facilitates mating with another electrical connector and whose manufacture is simplified.

An electrical connector of the present invention comprises an elongate insulative housing, a plurality of rectangular shield plates and a plurality of terminals received in the insulative housing. The insulative housing has a mounting face and a mating face. A pair of receiving channels extends through the insulative housing from the mounting face to the mating face for receiving the terminals, and a plurality of recesses is formed between the receiving channels for receiving the shield plates. Each receiving channel in the insulative housing disposes a plurality of upper ribs and lower ribs for retaining the terminals. Each terminal consists of a contact portion, a retention portion, a transverse portion and a soldering tail. Each retention portion has a first retaining section and a second retaining section. A pair of first locking barbs and a pair of second locking barbs are respectively formed on the first retaining section and the second retaining section of each terminal for fixing the terminal within the insulative housing. The transverse portions are formed between the first retaining sections and the second retaining sections and establish a transverse displacement therebetween for assuring reliable manufacturing and resilience of this long terminal.

Other objects, advantages and novel features of the invention will become more apparent from the following detailed description when taken in conjunction with the accompanying drawings.

DETAILED DESCRIPTION OF THE INVENTION

Figures 1, 2:
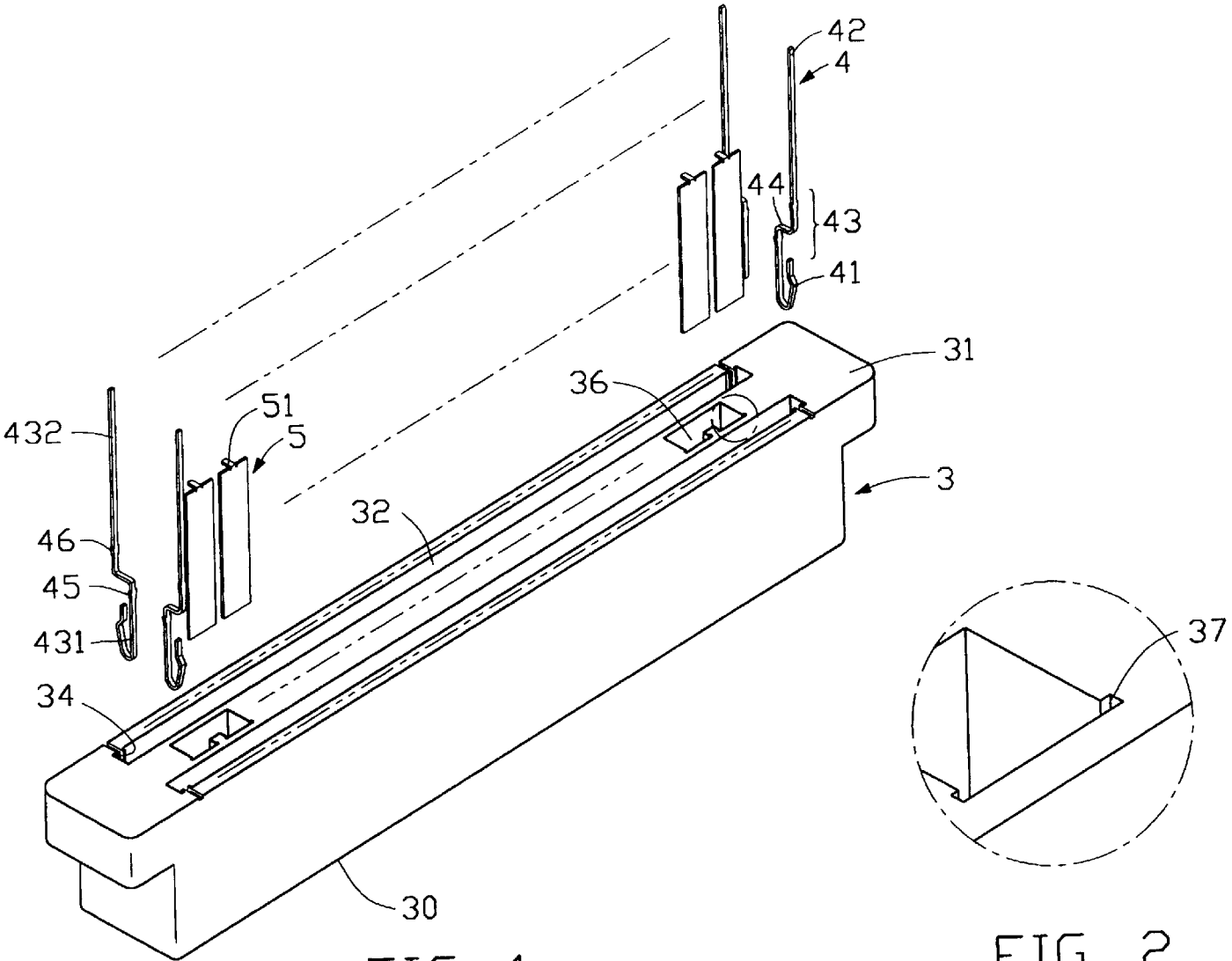
FIG. 1 is an exploded view of an electrical connector of the present invention from a bottom aspect.
FIG. 2 is a partial enlarged view of a recess of the electrical connector in FIG. 1.

Referring to FIGS. 1 and 2, an electrical connector of the present invention comprises an elongate insulative housing 3, a plurality of terminals 4 and a plurality of shield plates 5. The insulative housing 3 includes a mating face 30 at an upper surface for mating with a plug electrical connector (not shown) and a mounting face 31 at a lower surface for engaging with a printed circuit board. A pair of elongate receiving channels 32 extends through the insulative housing 3 from the lower surface to the upper surface, and a plurality of recesses 36 is defined therebetween. Each recess 36 receives a pair of rectangular shield plates 5, and an embossment (not labeled) is formed in the middle of a side of the recess 36 to segregate the two shield plates 5. A pair of cutouts 37 is respectively formed at opposite comers of a side of each recess 36 and on opposite sides of each embossment (not labeled) for latching the shield plates 5. A protrusion 51 extends perpendicularly from a bottom edge of each shield plate 5 for mating with a grounding trace on a printed circuit board. A plurality of lower ribs 34 and upper ribs 35 (see FIG. 3) respectively inwardly depends from the sides of each receiving channel 32 for isolating and securing the terminals 4. A plurality of pre-loading tabs 38 is formed on the outside wall of each receiving channel 32 and presses against the contact portion 41 of respective terminal 4, each pre-loading tab 38 having an inclined surface for facilitating insertion of the terminal 4 into the receiving channel 32.

Also referring to FIGS. 1 and 2, each terminal 4 comprises a contact portion 41, a retention portion 43, a transverse portion 44 and a soldering tail 42. Each retention portion 43 has a first retaining section 431 adjacent the contact portion 41 and a second retaining section 432 adjacent the soldering tail 42. Each transverse portion 44 is formed between the first retaining section 431 and the second retaining section 432 to establish a transverse displacement therebetween. A pair of first locking barbs 45 extends from opposite sides of each first retaining section 431, and a pair of second locking barbs 46 extends from opposite sides of each second retaining section 432. Each contact portion 41 reversely bends from the end of the first retaining section 431. In order to manufacture a terminal 4 with a transverse portion 44, a terminal mold must have two corresponding stamping sections. Each stamping section exerts a force on a portion of the terminal 4 which is shorter than the whole terminal 4. Therefore, the stamping force of each section of the mold is focused on a relatively short length so that each point of the terminal 4 is stamped with a relatively even force. Such an even force ensures that the terminal 4 will not be broken at a point where the stamping force is significantly large. It is apparent that by structuring the terminal 4 in this way, the percentage of defective output during manufacturing can be decreased.

Figure 3:
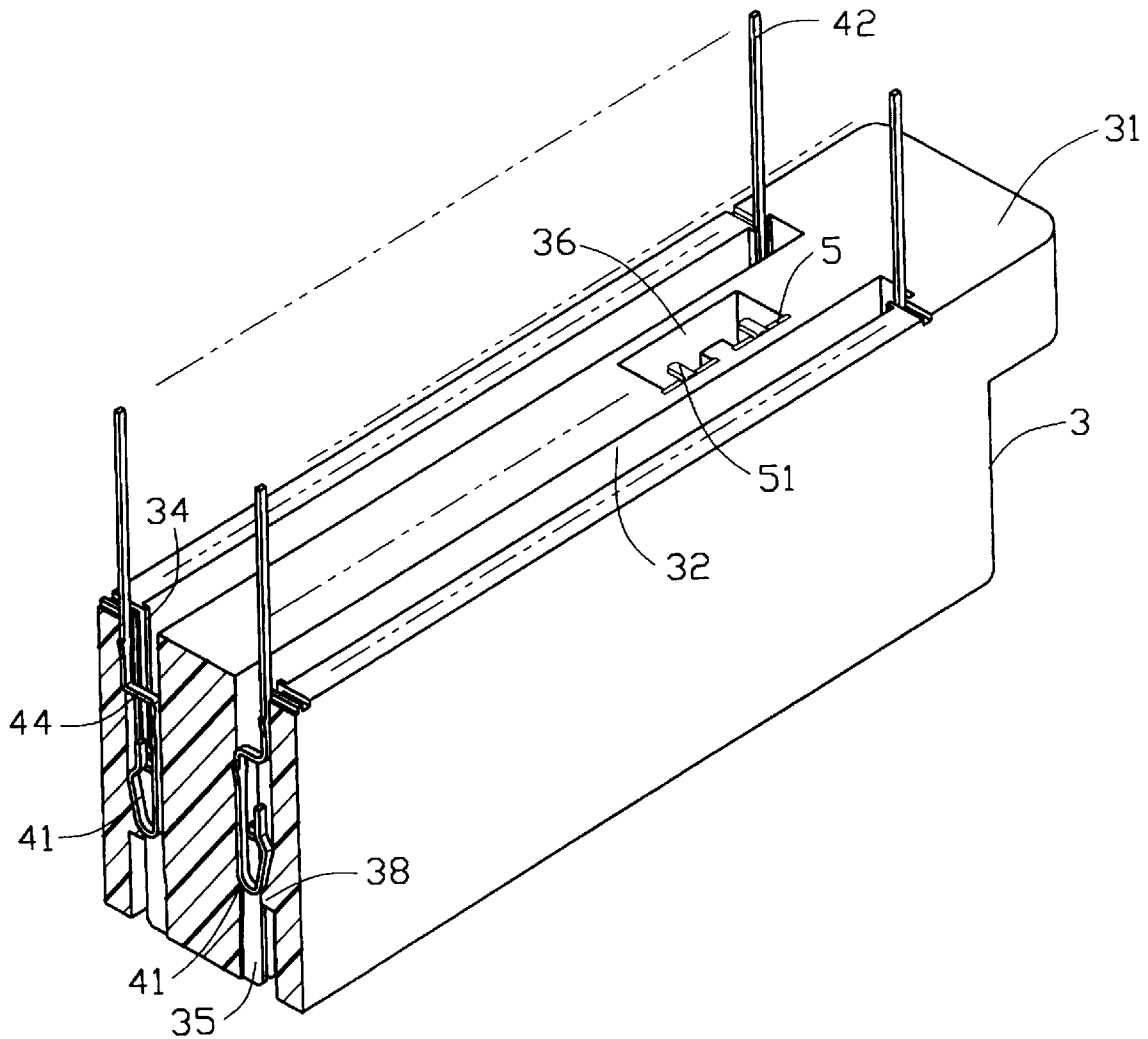
FIG. 3 is an assembled and cross-sectional view of the electrical connector of FIG. 1, wherein terminals of the electrical connector are assembled into an insulative housing at a first position.
Figure 4:
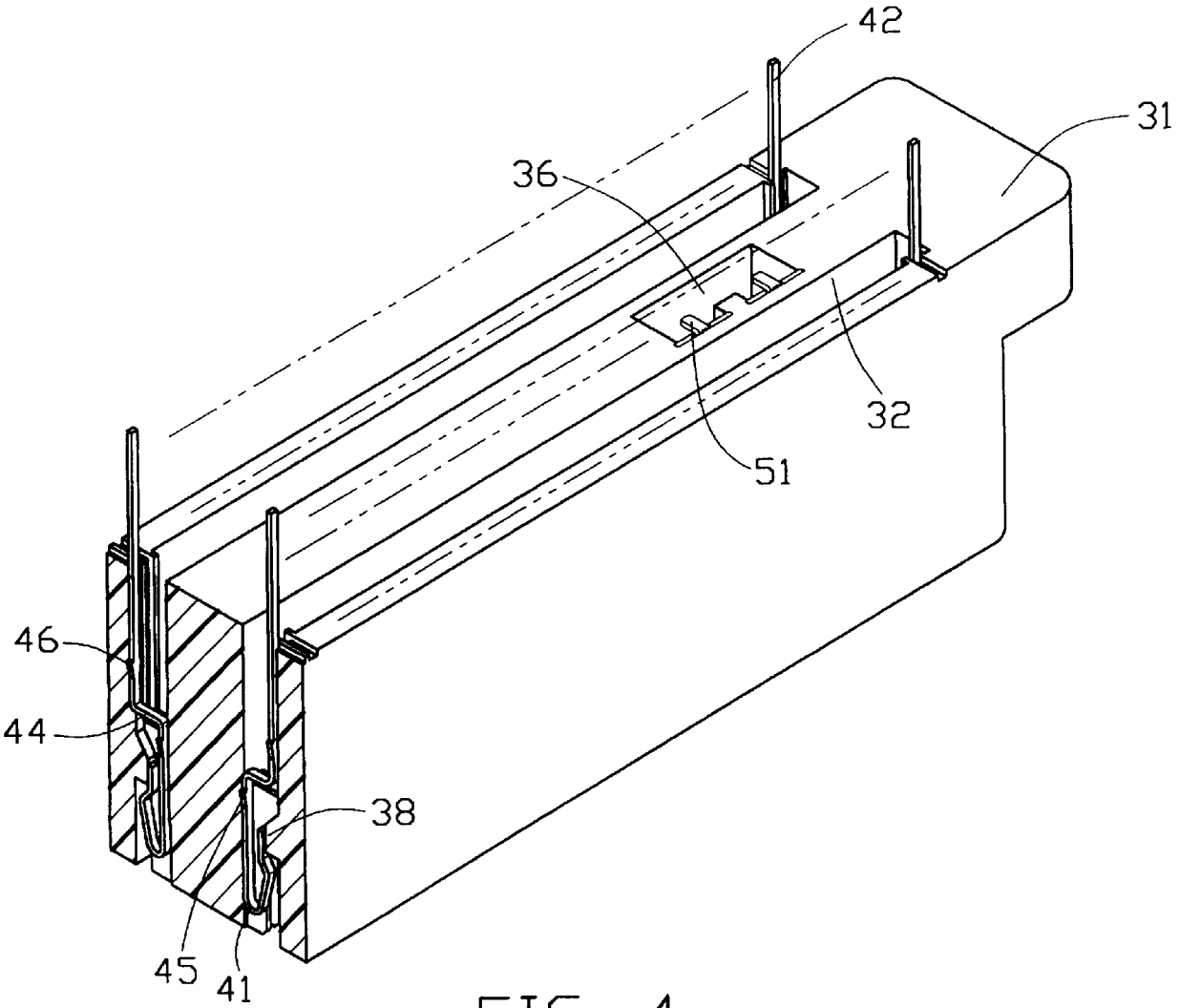
FIG. 4 is similar to FIG. 3, wherein the terminals of the electrical connector are assembled into the insulative housing at a second position.

Referring to FIG. 3, during assembly, a pair of shield plates 5 is first inserted into each recess 36 of the insulative housing 3, the opposite edges of each shield plate 5 fitting into opposite cutouts 37 of the recess 36. Each terminal 4 is inserted into the insulative housing 3 from the mounting face 31, the contact portion 41 being inserted first. The terminals 4 are sequentially inserted into the insulative housing 3 along the lower ribs 34 and the upper ribs 35 of the insulative housing 3. Referring to FIG. 3, at a first position, each contact portion 41 presses against the inclined surface of the pre-loading tab 38. Referring to FIG. 4, at a second position, the first locking barbs 45 and the second locking barbs 46 latch respectively with the upper ribs 35 and the lower ribs 34 of the insulative housing 3 to retain the terminals 4. The contact portions 41 of the terminals 4 abut against the side edges of the pre-loading tabs 38.

Figure 5:
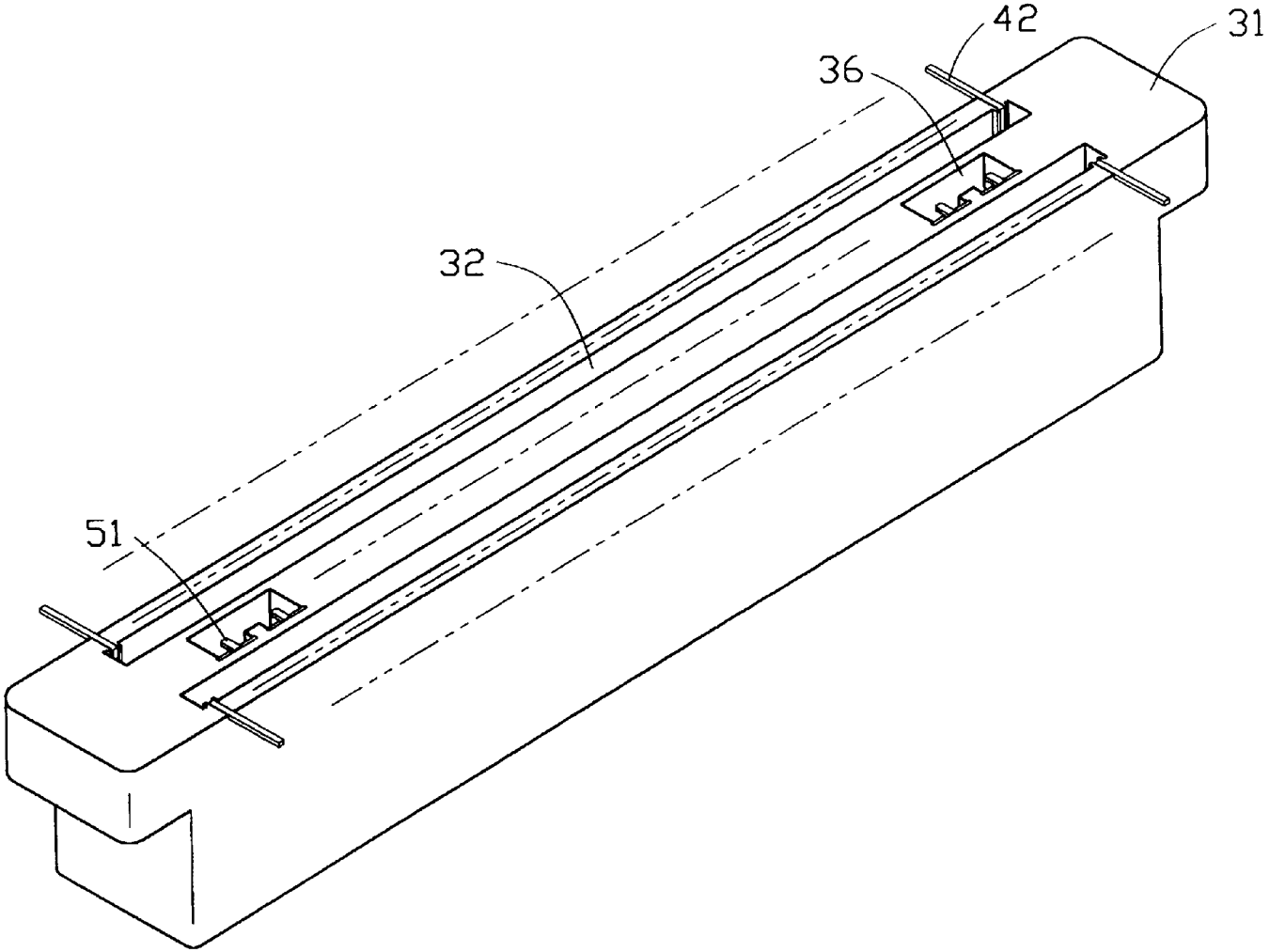
FIG. 5 is an assembled view of the electrical connector of FIG. 1.
Figure 6:
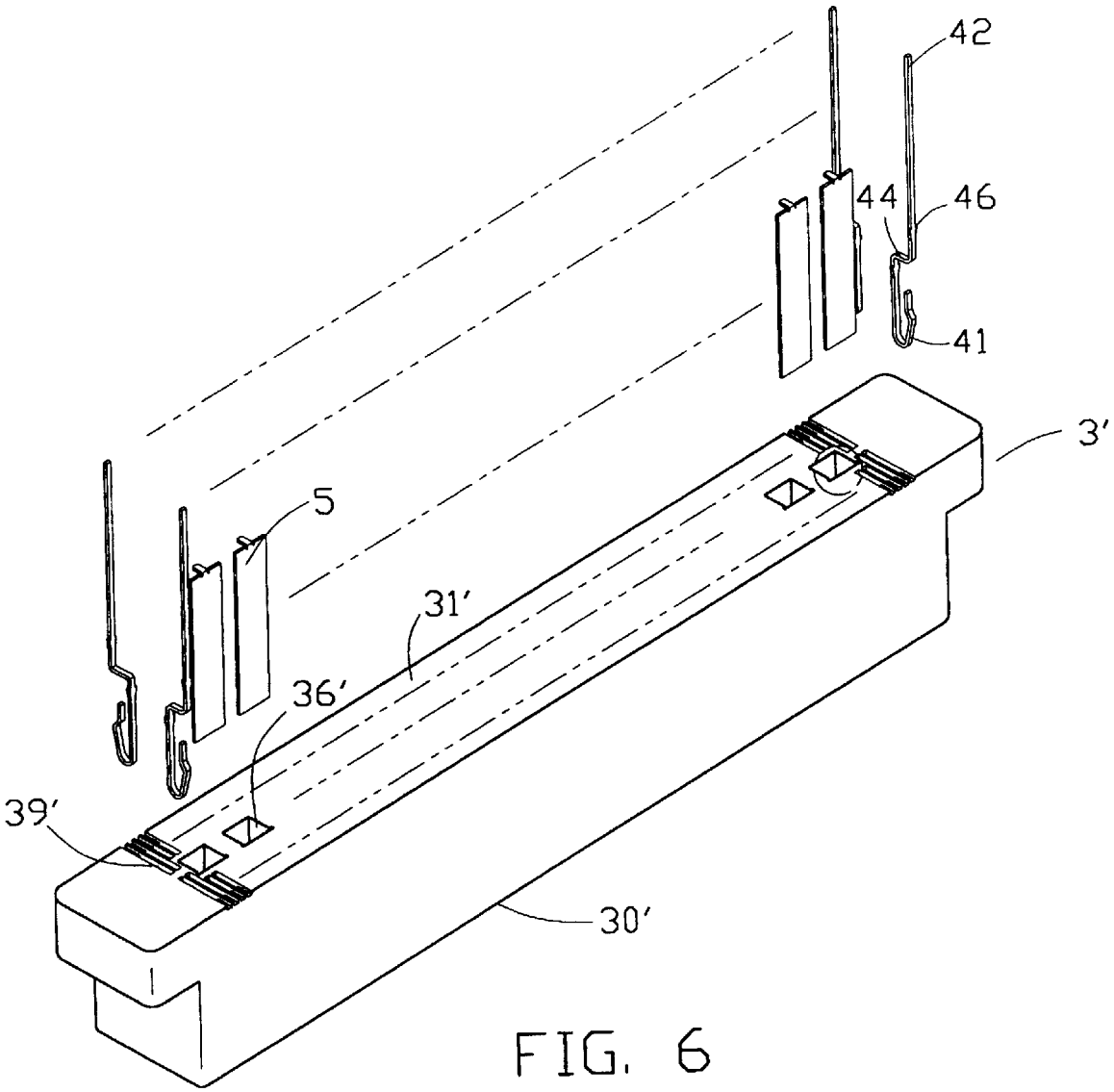
FIG. 6 is an exploded view of the electrical connector of a second embodiment from a bottom aspect.
Figure 7:
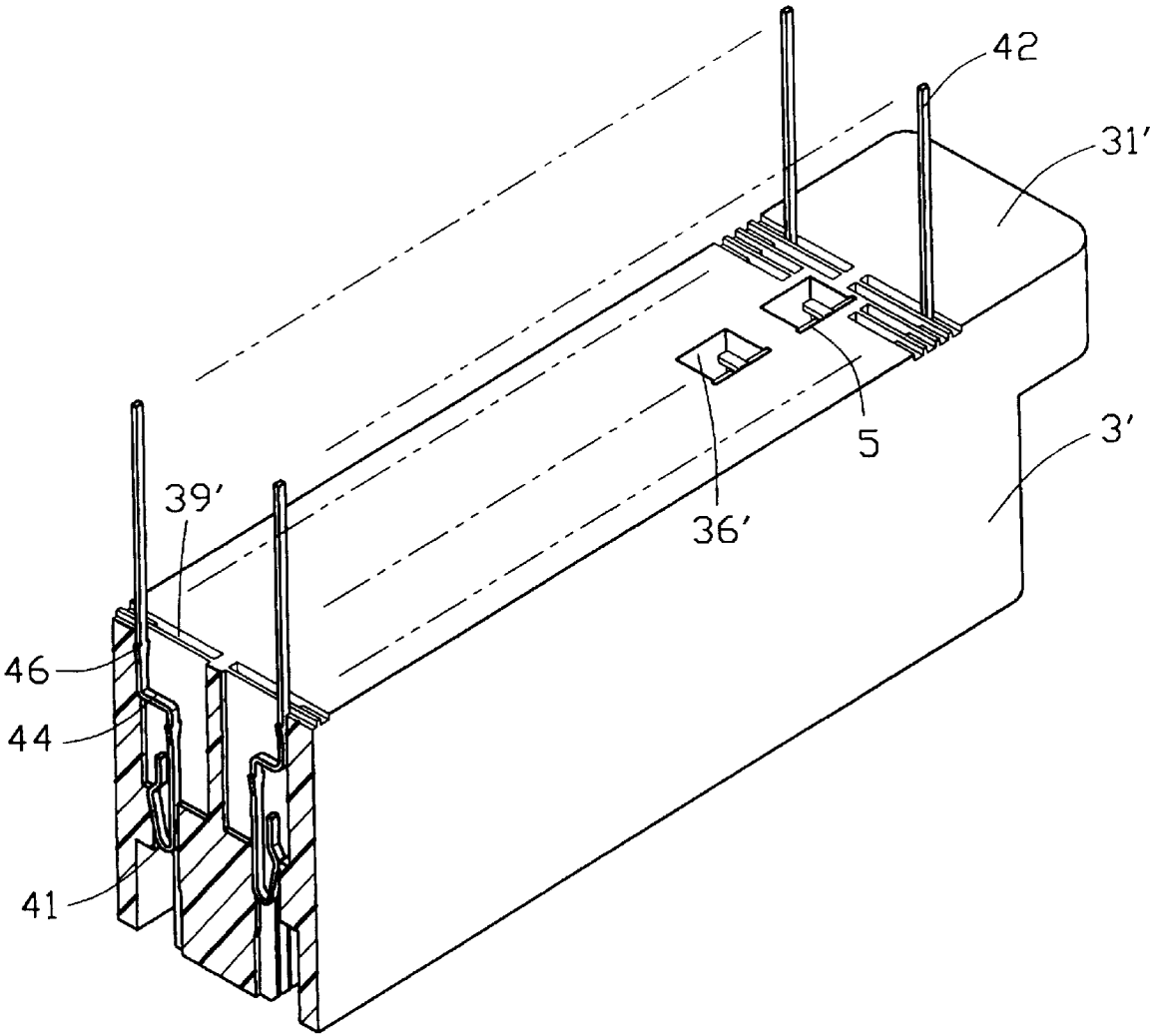
FIG. 7 is an assembled and cross-sectional view of the electrical connector of FIG. 6, wherein terminals of the electrical connector are assembled into an insulative housing at a first position.
Figure 8:
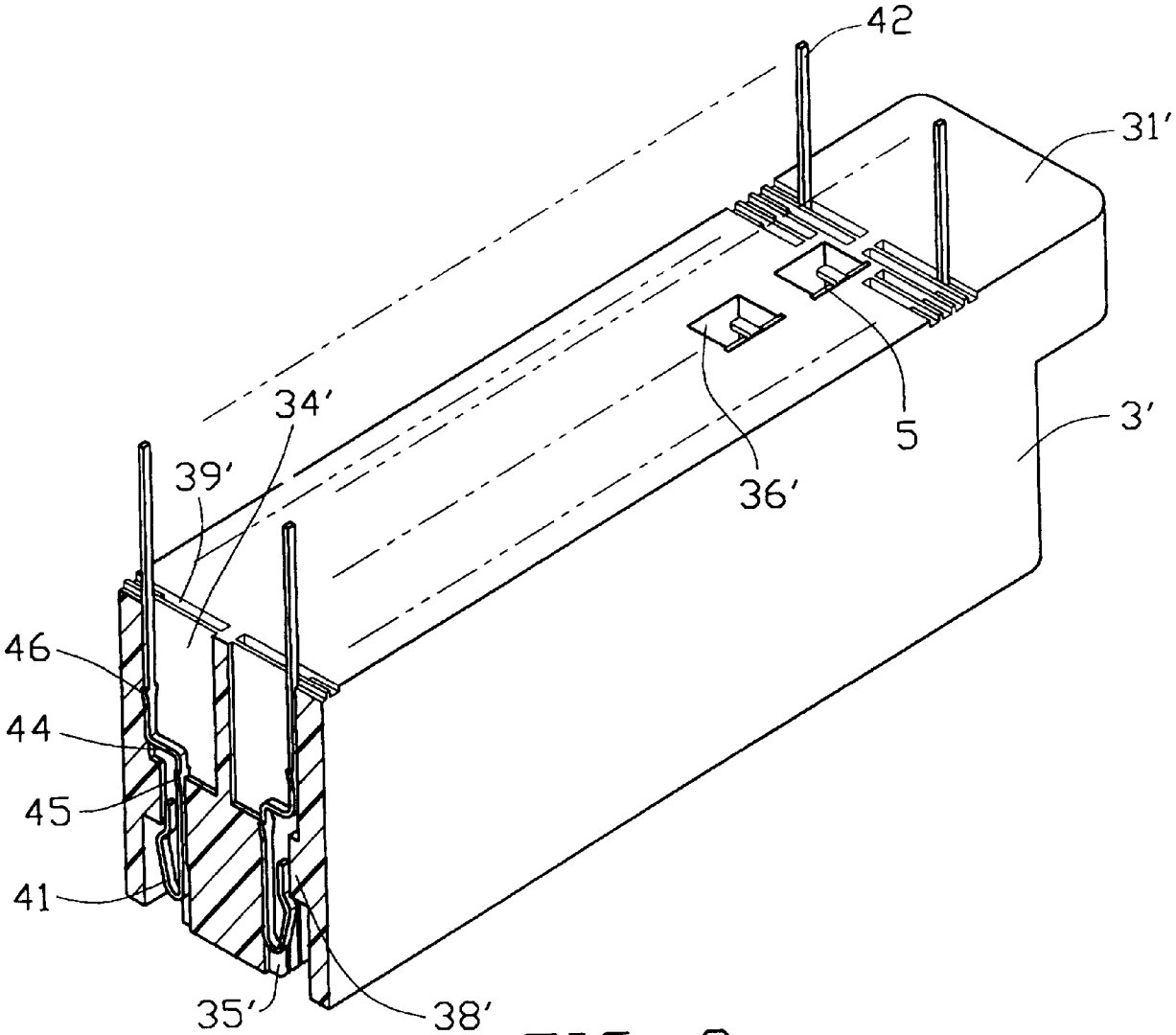
FIG. 8 is similar to FIG. 7, wherein the terminals of the electrical connector are assembled into the insulative housing at a second position.
Figure 9:
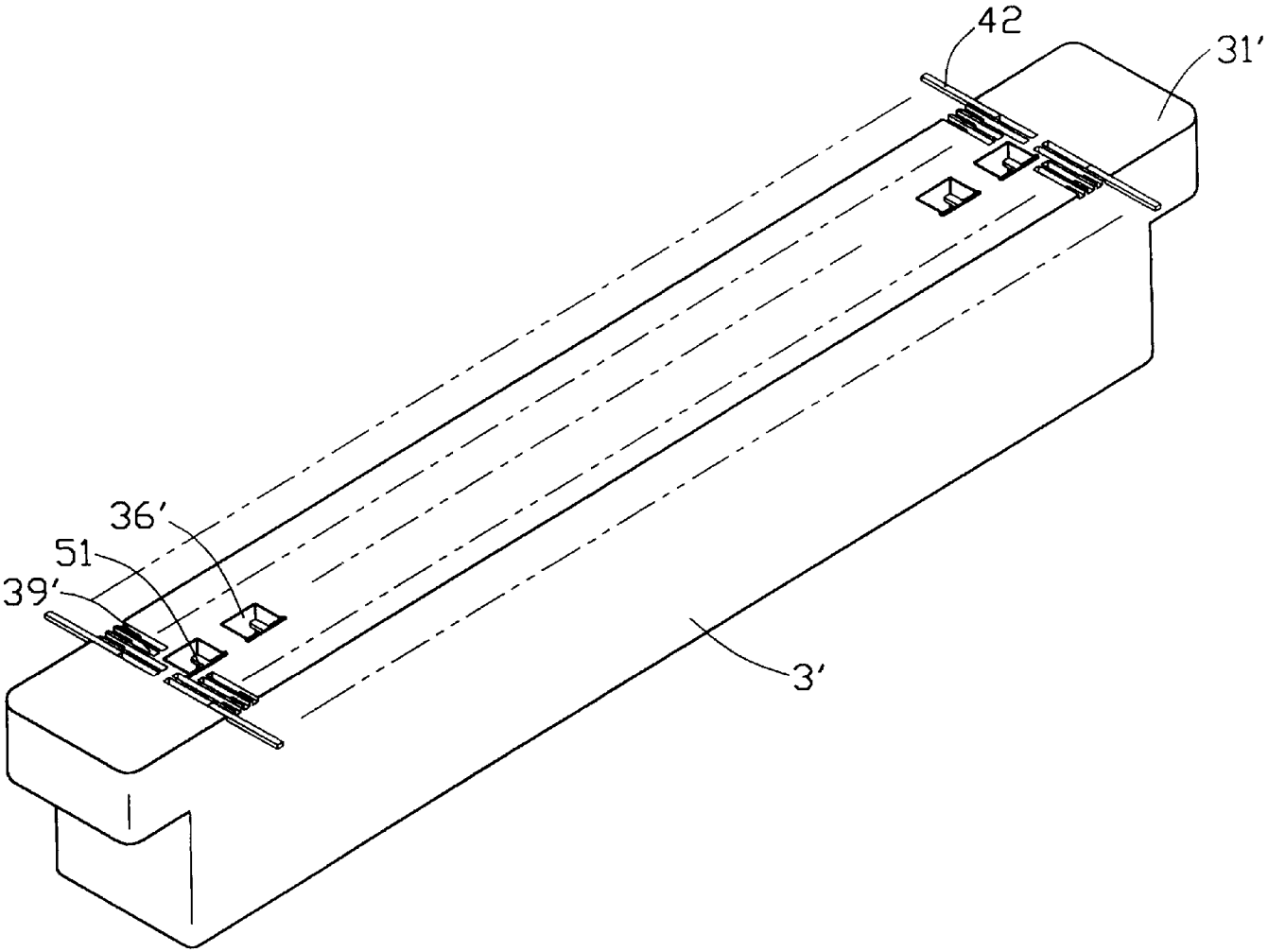
FIG. 9 is an assembled view of the electrical connector of FIG. 6.
Figure 10:
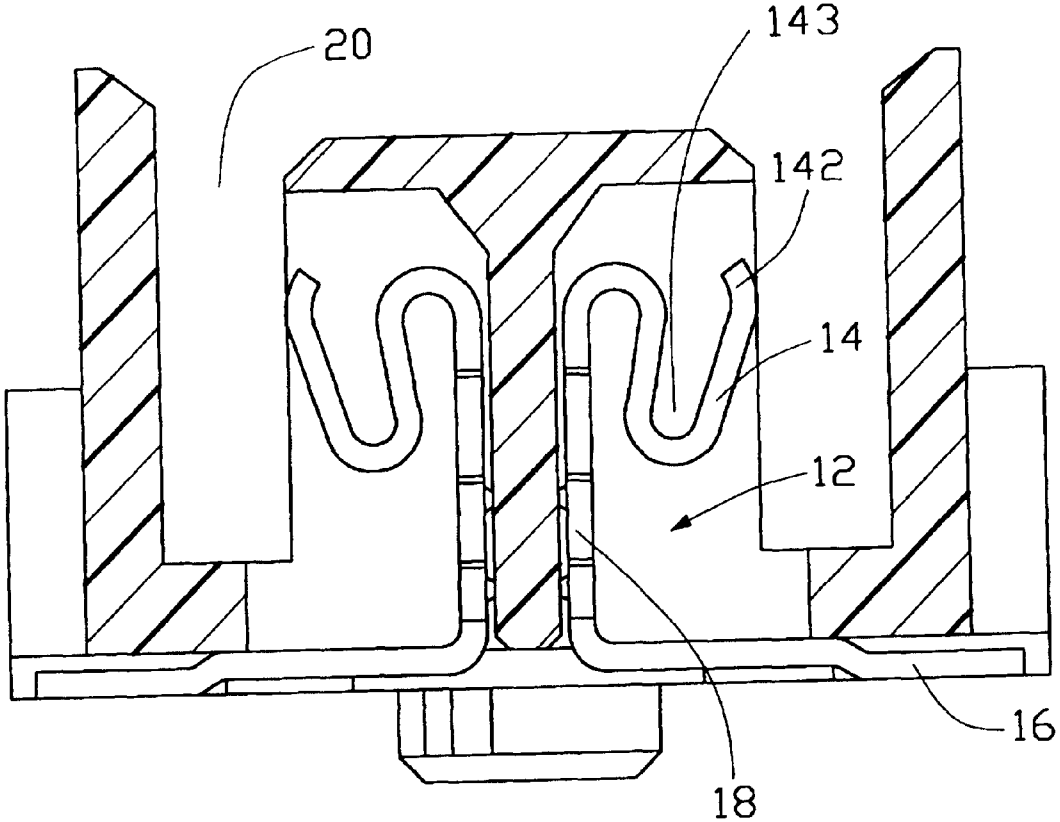
FIG. 10 (PRIOR ART)
FIG. 10 is a cross-sectional view of a conventional electrical connector.

Referring to FIG. 5, after complete insertion, the first retaining section 431 of each terminal 4 is secured between the two upper ribs 35 and the second retaining section 432 of each terminal 4 is secured between the two lower ribs 34. The first locking barbs 45 and the second locking barbs 46 assure reliable fixing of the terminals 4 in the receiving channels 32. After insertion of all terminals, the soldering tails 42 of the terminals 4 are bent outwardly to a substantial perpendicular position so that they are coplanar with the mounting face 31 of the insulative housing 3, fitting in short grooves (not labeled) in the mounting face 31 of the insulative housing 3. The soldering tail 42 on each terminal 4 and the protrusion 51 on each shield plate 5 can be soldered to a printed circuit board by SMT (Surface Mounting Technology), respectively.

An electrical connector of a second embodiment of the present invention is shown in FIGS. 6 to 9. The differences between the two embodiments reside in the configuration of the insulative housing. Therefore, like numerals are used in FIGS. 6 to 9 to designate like components of the electrical connector which correspond to those of the electrical connector in FIGS. 1 to 5. A plurality of separated cavities 39' is defined through the insulative housing 3 for receiving terminals 4, the cavities 39' being separated by membranes 34' formed between the cavities 39'. A plurality of upper ribs 35' integrally extends from each membrane 34' on an inward side of each cavity 39' (see FIG. 8) for isolating and securing the first retaining sections 431 of the terminals 4. A plurality of pre-loading tabs 38' each having a planar surface is formed on an outside wall of each cavity 39' for fixing the terminals 4. In assembly, terminals 4 are inserted into the cavities 39' in the mounting face 31' in a manner similar to that of the first embodiment. When fully inserted, The first locking barbs 45 of the terminals 4 engage with the upper ribs 35' of the housing 3', and the second locking barbs 46 of the terminals 4 engage with the membranes 34' on each side of each cavity 39'. Moreover, a plurality of recesses 36' spaced apart from each other is defined in the center of the mounting face 31' of the insulative housing 3' for receiving shield plates 5.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a mounting face, a mating face, and a pair of receiving channels extending through the insulative housing from the mounting face to the mating face, a plurality of upper ribs and lower ribs being respectively formed on inside and outside walls of each receiving channel; and a plurality of terminals each including a soldering tail, a first retaining section, a second retaining section, a transverse portion formed between the first retaining section and the second retaining section, and a contact portion curvedly extending from an end of the first retaining section, the first retaining section being secured between two adjacent upper ribs of the insulative housing, the second retaining section being secured between two adjacent lower ribs of the insulative housing;

wherein a pre-loading tab is formed on the outside wall of each receiving channel and presses against the contact portion of respective terminal, each pre-loading tab having an inclined surface for facilitating insertion of the terminal into the receiving channel.

2. The electrical connector as claimed in claim 1, further comprising a plurality of shield plates each having a protrusion extending from a bottom edge thereof for mating with a grounding trace on a printed circuit board, and wherein the insulative housing comprises a plurality of recesses defined between the pair of receiving channels thereof for receiving the shield plates.

3. The electrical connector as claimed in claim 2, wherein each recess receives a pair of shield plates, and an embossment extends from a sidewall of the recess to interpose between the pair of shield plates.

4. The electrical connector as claimed in claim 1, wherein a pair of first locking barbs is disposed on the first retaining section of each terminal and a pair of second locking barbs is disposed on the second retaining section of each terminal to secure the terminal to the insulative housing.

5. An electrical connector comprising:

an insulative housing having a lower mounting face and an upper mating face and defining a plurality of separated cavities; and a plurality of terminals each including a soldering tail, a first retaining section secured in one sidewall of the cavity of the insulative housing, a second retaining section secured in an opposite sidewall of the cavity of the insulative housing, a contact portion curvedly extending from an upper end of the first retaining section, and a transverse portion formed between the first retaining section and the second retaining section; and a plurality of shield plates each having a protrusion for mating with a grounding trace on a printed circuit board;

wherein the insulative housing comprises a plurality of recesses defined between the pair of receiving channels thereof for receiving the shield plates, the plurality of recesses being spaced from each other and extending through the insulative housing from the mounting face to the mating face, each recess receiving one shield plate, a pair of cutouts being formed in opposite corners of each recess for receiving the opposite edges of each shield plate.

6. The electrical connector as claimed in claim 5, wherein a plurality of locking barbs is disposed on each of the first and the second retaining sections for securing the terminal to the insulative housing.

7. An electrical connector comprising:

an insulative housing defining plural pairs of cavities along a longitudinal direction thereof;

plural pairs of terminals respectively disposed within the corresponding cavities, each pair of contacts being mirror-image with each other, each of said pair of terminals including a first vertical retaining section and a second vertical retaining section offset from each other in both vertical and horizontal directions with a transverse portion therebetween, a contact portion curvedly upwardly extending from an end of the upper retaining section, and a soldering tail horizontally extending at a lower end of the terminal; wherein said first vertical retaining section is positioned close to the contact portion and the second vertical retaining section is close to the soldering tail so as to efficiently resist forces imposed upon the contact portion and the soldering tail, respectively.

8. The connector as claimed in claim 7, wherein said contact portion of each terminal is reversely bent from the end of the upper retaining section and substantially positioned above and vertically aligned with said transverse portion thereof.

9. The connector as claimed in claim 8, wherein both said contact portion and said transverse portion of each terminal are not vertically aligned with said soldering tail thereof.

10. The connector as claimed in claim 9, wherein a distal free end of the contact portion of each of the terminals abuts against a pre-loading tab formed an outside wall beside the corresponding cavity, so that each corresponding pair of terminals in the same cross section of the housing respectively abut against the corresponding pre-loading tabs oppositely formed by two sides of said pair of terminals.

* * * * *